US010190369B2

(12) United States Patent
Olsen et al.

(10) Patent No.: US 10,190,369 B2
(45) Date of Patent: Jan. 29, 2019

(54) BIT INCORPORATING DUCTILE INSERTS

(71) Applicant: HALLIBURTON ENERGY SERVICES, INC., Houston, TX (US)

(72) Inventors: Garrett T. Olsen, Conroe, TX (US); Grant O. Cook, III, Spring, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 415 days.

(21) Appl. No.: 15/032,578

(22) PCT Filed: May 7, 2015

(86) PCT No.: PCT/US2015/029735
§ 371 (c)(1),
(2) Date: Apr. 27, 2016

(87) PCT Pub. No.: WO2016/178693
PCT Pub. Date: Nov. 10, 2016

(65) Prior Publication Data

US 2017/0101825 A1 Apr. 13, 2017

(51) Int. Cl.

| | |
|---|---|
| ***E21B 10/54*** | (2006.01) |
| ***E21B 10/42*** | (2006.01) |
| ***E21B 10/55*** | (2006.01) |
| ***E21B 10/60*** | (2006.01) |
| ***B22F 7/08*** | (2006.01) |
| ***B22F 5/00*** | (2006.01) |
| ***C22C 29/00*** | (2006.01) |

(Continued)

(52) U.S. Cl.
CPC ..... *E21B 10/54* (2013.01); *B22F 7/08* (2013.01); *E21B 10/42* (2013.01); *E21B 10/55* (2013.01); *B22F 2005/001* (2013.01); *C22C 26/00* (2013.01); *C22C 29/00* (2013.01); *C22C 32/00* (2013.01); *E21B 10/602* (2013.01)

(58) Field of Classification Search
CPC ..... E21B 10/54; E21B 10/42; E21B 10/55; E21B 10/602; B22F 7/08; B22F 2005/001; C22C 29/00; C22C 26/00; C22C 32/00
See application file for complete search history.

(56) References Cited

U.S. PATENT DOCUMENTS

| | | | |
|---|---|---|---|
| 4,667,756 | A | 5/1987 | King et al. |
| 5,090,491 | A | 2/1992 | Tibbitts et al. |

(Continued)

FOREIGN PATENT DOCUMENTS

| | | | |
|---|---|---|---|
| CN | 103210171 | A | 7/2013 |
| CN | 104321501 | A | 1/2015 |
| WO | 2010075168 | A2 | 7/2010 |

OTHER PUBLICATIONS

AISI 1018 Steel (Year: 1996).*

(Continued)

*Primary Examiner* — Wei Wang
(74) *Attorney, Agent, or Firm* — Polsinelli PC

(57) ABSTRACT

A fixed-cutter drill bit is provided that includes a metal-matrix composite body having at least one metal-matrix composite blade. Cutters are disposed on the blades. A ductile insert is partially disposed within the body and has an exposed surface. The ductile insert has a greater ductility than the metal-matrix composite thereby alleviating stresses imposed on the metal-matrix composite during manufacture of the bit or drilling.

19 Claims, 11 Drawing Sheets

(51) Int. Cl.
*C22C 26/00* (2006.01)
*C22C 32/00* (2006.01)

(56) References Cited

U.S. PATENT DOCUMENTS

| | | | | |
|---|---|---|---|---|
| 5,099,935 | A * | 3/1992 | Anthon | E21B 10/567 175/415 |
| 6,216,805 | B1 | 4/2001 | Lays et al. | |
| 8,272,295 | B2 | 9/2012 | Smith et al. | |
| 8,448,725 | B2 | 5/2013 | Mensa-Wilmot | |
| 8,602,129 | B2 | 12/2013 | Lockwood | |
| 8,757,297 | B2 | 6/2014 | Aliko et al. | |
| 8,869,919 | B2 | 10/2014 | Shen et al. | |
| 8,881,791 | B2 | 11/2014 | Eason et al. | |
| 8,945,720 | B2 | 2/2015 | Shresta et al. | |
| 2002/0084111 | A1 | 7/2002 | Evans | |
| 2010/0075168 | A1 | 3/2010 | Schaffer | |
| 2010/0193254 | A1 | 8/2010 | Lind et al. | |
| 2011/0107589 | A1 | 5/2011 | Choe et al. | |
| 2011/0186261 | A1 | 8/2011 | Choe et al. | |
| 2013/0153306 | A1 | 6/2013 | Burhan et al. | |
| 2013/0247475 | A1 | 9/2013 | Lind et al. | |
| 2014/0182935 | A1 | 7/2014 | Weaver | |

OTHER PUBLICATIONS

International Search Report and Written Opinion dated Jan. 28, 2016 in International Application No. PCT/US2015/029735.
Chinese Office Action; Chinese Application No. 201580078588.5; dated Sep. 26, 2018.
English abstract of CN104321501; retrieved from www.espacenet.com on Oct. 25, 2018.
English abstract of CN103210171; retrieved from www.espacenet.com on Oct. 25, 2018.

* cited by examiner

BIT INCORPORATING DUCTILE INSERTS

CROSS-REFERENCE TO RELATED APPLICATIONS

This application is a national stage entry of PCT/US2015/029735 filed May 7, 2015, said application is expressly incorporated herein in its entirety.

FIELD

The present disclosure relates generally to drill bits. In particular, the subject matter herein generally relates to fixed-cutter drill bits for use in drilling systems for oil and gas exploration and production.

BACKGROUND

Hydrocarbon exploration involves drilling deep within the earth to find hydrocarbon-producing formations. To drill a wellbore, a drill bit is provided at the end of a drill string and rotated to form a wellbore. One type of a drill bit is the fixed-cutter drill bit. Such drill bits generally include an array of cutters secured to a face region of the bit body. The cutters of a fixed-cutter drill bit generally have a substantially cylindrical shape. A hard, superabrasive material, such as polycrystalline diamond, may be provided on each cutter, providing a cutting surface for engaging the formation during drilling. Such cutters are often referred to as polycrystalline diamond compact (PDC) cutters. Typically, the cutters are fabricated separately from the bit body and secured within cutter recesses or pockets formed in the outer surface of the bit body. A bonding material, such as a braze alloy, may be used to secure the cutters to the bit body. A fixed-cutter drill bit is placed in a borehole such that the cutters are in contact with the earth formation to be drilled. As the drill bit is rotated, the cutting elements scrape across and shear away the surface of the underlying formation.

The body of the drill bit may be formed from a metal-matrix composite material. Such materials include reinforcement particles randomly dispersed throughout a matrix material, often referred to as a binding material. Metal-matrix composite bit bodies may be formed by embedding a metal mandrel or blank in a particulate material volume, such as particles of tungsten carbide, and then infiltrating the particulate material with a matrix material, such as a copper alloy.

Drill bits that have a body formed from such metal-matrix composites offer significant advantages over all-steel bit bodies, including increased erosion and wear resistance, but generally have lower toughness and other constraints, such as lower blade standoff, that limit their use in certain applications. In particularly harsh drilling environments involving complex loading of the drill bit, metal-matrix composite bodies subject to extremes of cyclical loading are known to be subject to various forms of cracking. Once a crack is initiated, further cyclical loading can cause the crack to propagate through the matrix and can lead to premature failure of the bit. Such failures are costly, as they generally require cessation of drilling while the drill string and drill bit are removed from the borehole for repair or replacement of the drill bit.

BRIEF DESCRIPTION OF THE DRAWINGS

Implementations of the present technology will now be described, by way of example only, with reference to the attached figures, wherein.

DETAILED DESCRIPTION

Figure 1:
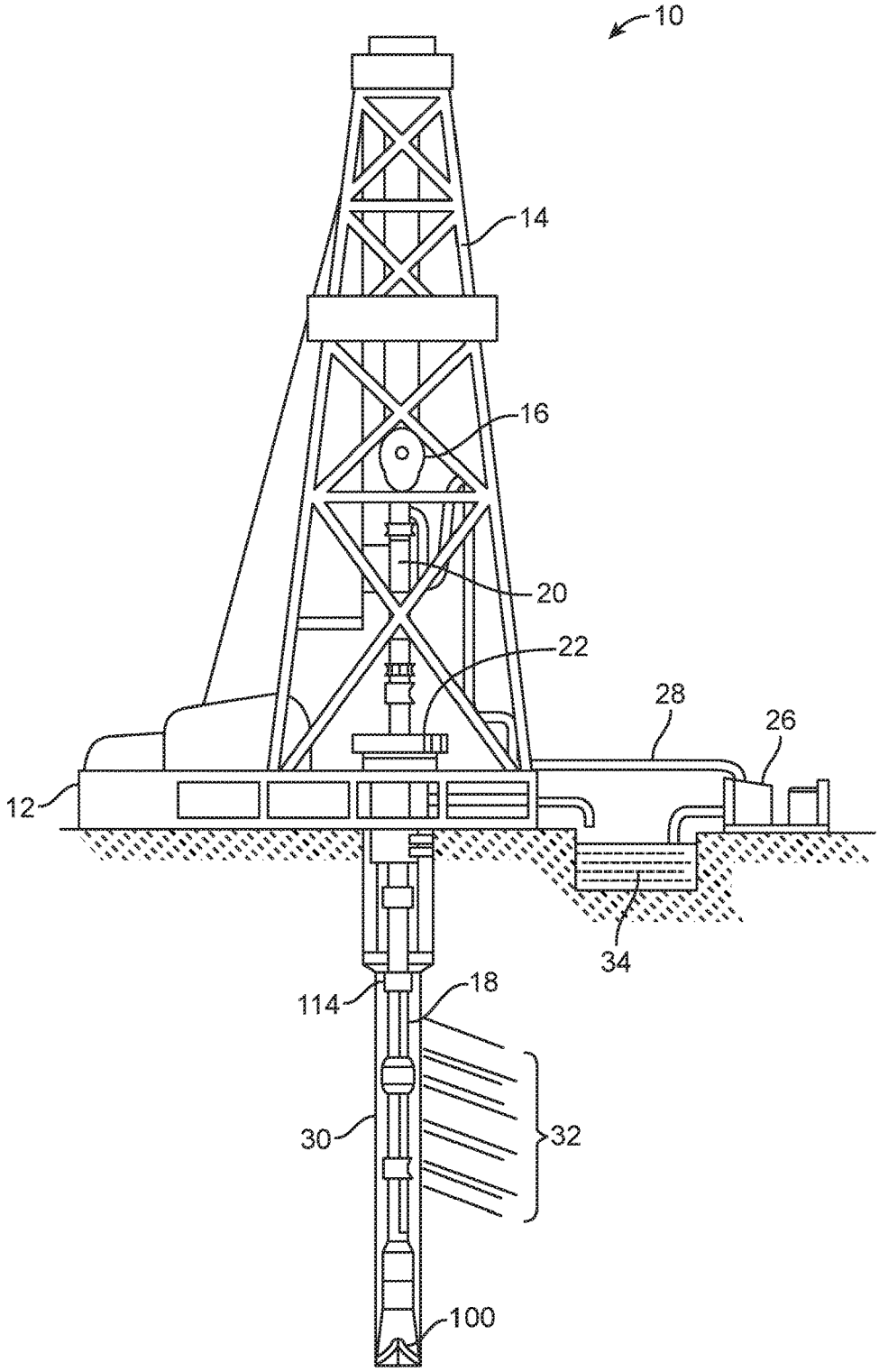
FIG. 1 is a diagram illustrating an exemplary environment for a drill bit according to the disclosure herein.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

In the following description, terms such as "upper," "upward," "lower," "downward," "above," "below," "downhole," "uphole," "longitudinal," "lateral," and the like, as used herein, shall mean in relation to the bottom or furthest extent of, the surrounding wellbore even though the wellbore or portions of it may be deviated or horizontal. Correspondingly, the transverse, axial, lateral, longitudinal, radial, etc., orientations shall mean orientations relative to the orientation of the wellbore or tool. Further the term "proximal" herein refers directionally to portions of the drill bit toward the blades in relation to "distal" which refers directionally away from the blades of the drill bit.

Several definitions that apply throughout this disclosure will now be presented. The term "coupled" is defined as connected, whether directly or indirectly through intervening components, and is not necessarily limited to physical connections. The term "communicatively coupled" is defined as connected, either directly or indirectly through intervening components, and the connections are not necessarily limited to physical connections, but are connections that accommodate the transfer of data between the so-described components. The connection can be such that the objects are permanently connected or releasably connected. The term "outside" refers to a region that is beyond the outermost confines of a physical object. The term "axially"

means substantially along a direction of the axis of the object. If not specified, the term axially is such that it refers to the longer axis of the object. The terms "comprising," "including" and "having" are used interchangeably in this disclosure. The terms "comprising," "including" and "having" mean to include, but not necessarily be limited to the things so described.

The present disclosure teaches a variety of ways to improve the toughness and durability of a drill bit in view of these issues. In one example, a drill bit includes specially selected ductile inserts strategically positioned within the body to reduce or eliminate such cracking. The ductile inserts can be exposed and made flush with the external surface of the bit body. Due to the ductility of the ductile inserts, the drill bit can withstand the forces exerted thereon by reducing or eliminating cracking in the bit body or halting the progress of existing cracks.

The useful service lives of metal-matrix composite bodies used in drill bits under extremes of cyclical loading and temperature may now be improved as taught herein. Cracking that might ordinarily occur in certain regions of the metal-matrix composite bodies as a result of higher loading and resultant stresses in these regions may be reduced. Portions of the bodies in which cracking may be reduced include regions surrounding and proximate to the various nozzles/ports of the body where radial cracks may otherwise have occurred related to stress concentrations associated with the geometric features of the port/nozzle feature and region. The specially selected inserts may be strategically placed at these locations to prevent or arrest such cracks.

The specially selected inserts may also be strategically placed at other locations that have shown a propensity for cracking, such as regions surrounding and proximate to a respective cutter. Cracking which may be caused at least in part by residual stresses (tensile stresses) in these regions of the body as the respective cutters engage various earth formations during drilling may be reduced. Yet another portion of the bodies where the specially selected inserts may be strategically placed are blade roots, which are defined as regions of the bodies from which the blades protrude on the cutter side of the blade, where cracking has been observed to radiate from the root into the body generally underneath the blade, and which may be associated with the concentration of tensile forces in these regions as the cutters and their respective blades engage various earth formations. Such cracking that may occur during the manufacturing process due to sufficiently high residual stresses may also be reduced. As such, the inserts may prevent failure of the drill bit, such as loss of a blade, necessitating removal of the drill bit and drill string which can be very costly. The specially selected inserts may reduce or eliminate such cracking, particularly in regions of the bit body that have a particular propensity for the same.

Turning now to the figures, an exemplary drilling system 10 having a drill bit 100 is illustrated in FIG. 1. The drilling system 10 can include a well head 22 at the surface, as well as a drilling platform 12 which is equipped with a derrick 14 that supports a hoist 16 for raising and lowering a drill string 18. The hoist 16 suspends a top drive 20 that is used to rotate the drill string 18 and to lower the drill string 18 through a well head 22. Sections of the drill string 18 are connected by threaded connectors 114. Connected to the lower end of the drill string 18 is the drill bit 100. As the drill bit 100 rotates, the drill bit 100 creates a borehole 30 that passes through various formations 32. A pump 26 circulates drilling fluid through a supply pipe 28 to the top drive 20, downhole through the interior of the drill string 18, through orifices in the drill bit 100, back to the surface via the annulus around the drill string 18, and into a retention pit 34. The drilling fluid transports cuttings from the borehole into the pit 34 and aids in maintaining the integrity of the borehole 30.

The drill bit 100 can be one piece of a bottom-hole assembly that includes one or more drill collars (thick-walled steel pipe) to provide weight and rigidity to aid the drilling process. Some of these drill collars include logging instruments to gather measurements of various drilling parameters such as position, orientation, weight-on-bit, borehole diameter, etc. The tool orientation may be specified in terms of a tool face angle (a.k.a. rotational or azimuthal orientation), an inclination angle (the slope), and a compass direction, each of which can be derived from measurements by magnetometers, inclinometers, and/or accelerometers, though other sensor types such as inertial sensors and gyroscopes may additionally or alternatively be used to determine position as well as orientation. The tool can include a 3-axis fluxgate magnetometer and/or a 3-axis accelerometer. The combination of those two sensor systems enables the measurement of the tool face angle, inclination angle, and compass direction. The tool face and hole inclination angles may be calculated from the accelerometer sensor output.

Figure 2:
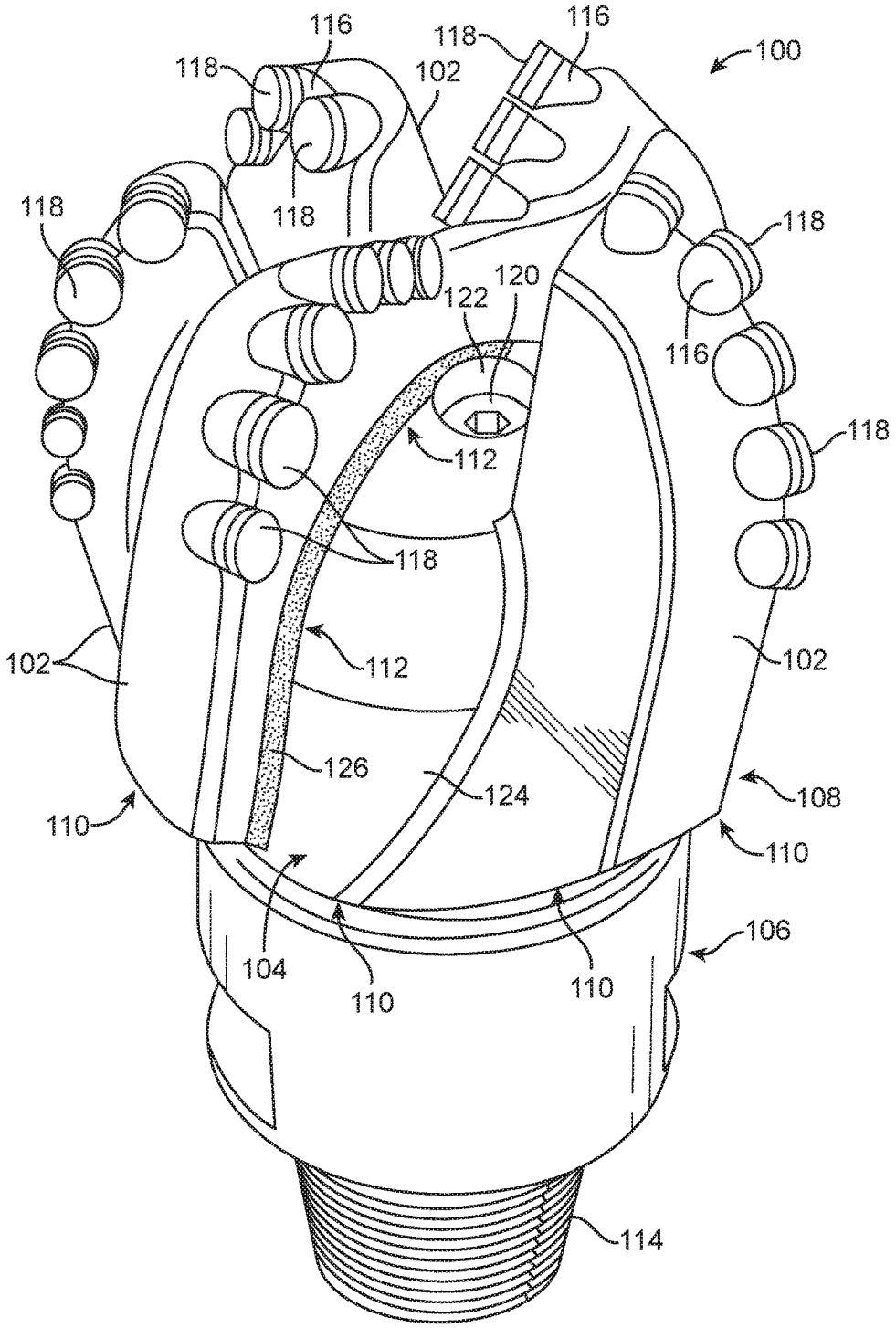
FIG. 2 is a diagram illustrating a first embodiment of a drill bit according to the disclosure herein.

FIG. 2 illustrates one example of a fixed-cutter drill bit 100 having one or more ductile inserts 126 disposed in the body 108 of the drill bit 100 and flush with the exterior portion thereof in accordance with the present disclosure. The drill bit 100 can include a body 108 having a plurality of blades 102 extending radially from a central portion of the body 108, each being made of a metal-matrix composite material (described below). The plurality of blades 102 can be integrally formed in and part of the body 108. Respective fluid flow paths (also referred to as "junk slots") 124 can be disposed between adjacent blades 102.

A proximal end of the drill bit 100 can include a plurality of cutters 118 operable to engage downhole formation materials and remove such materials to form a wellbore. Each cutter 118 can be disposed in respective cutter pockets 116 formed on an exterior portion of respective blade 102. Each cutter 118 can include respective cutting surface formed from hard materials satisfactory for engaging and removing adjacent downhole formation materials.

Cutters 118 can scrape and gouge formation materials from the bottom and sides of a wellbore (not shown) during rotation of drill bit 100. For some applications, various types of polycrystalline diamond compact (PDC) cutters can be satisfactorily used as cutters 118. A drill bit having PDC cutters can sometimes be referred to as a "PDC bit".

One or more nozzle openings 120 can be formed in exterior portions of the body 108. Respective nozzles 122 can be disposed in each nozzle opening 120. Various types of drilling fluid may be pumped from surface drilling equipment (shown in FIG. 1) through an associated drill string 18 (shown in FIG. 1) attached to the threaded pin 114 of the shank or 106 to fluid flow passageway disposed within the body 108. One or more fluid flow passageways can be formed in the body 108 to communicate drilling fluid and/or other fluids to associated nozzles 120. See for example fluid passageways 972 in FIG. 10.

A distal end of the body 108 of the drill bit 100 can include at least one bevel 110. The bevel 110 can be placed at the distal end of a blade 102 which protrudes from the central portion 104 of the body 108. The bevel 110 can protrude from the central portion 104 of the body 108 further than the shank 106 which is described below.

A distal end of the drill bit 101 can also include a shank 106 operable to releasably engage the drill bit 101 with a drill string (shown in FIG. 1), bottom hole assembly (not shown) and/or a downhole drilling motor (not shown) to rotate the drill bit 100 during formation of a borehole. Shank 106 and associated bit blank 36 (shown in FIG. 10) can be described as having respective generally hollow cylindrical configurations defined in part by a fluid flow passageway extending therethrough. Various types of threaded connections such as American Petroleum Institute (API) drill pipe connection or threaded pin 114 can be formed on the shank 106 proximate the distal end of the drill bit 101.

The body 108, and its plurality of blades 102, can be made up of a metal-matrix composite. The metal-matrix composite can include any suitably hard material as the reinforcement material, such as tungsten carbide, and any suitably ductile material as the matrix material, such as a pure metal or metal alloy. For example, the metal-matrix composite can include, but is not limited to, copper, nickel, cobalt, iron, aluminum, molybdenum, chromium, manganese, tin, zinc, lead, silicon, tungsten, boron, phosphorous, gold, silver, palladium, indium, any mixture thereof, any alloy thereof, and any combination thereof. Non-limiting examples of alloys of the binder material 324 may include copper-phosphorus, copper-phosphorous-silver, copper-manganese-phosphorous, copper-nickel, copper-manganese-nickel, copper-manganese-zinc, copper-manganese-nickel-zinc, copper-nickel-indium, copper-tin-manganese-nickel, copper-tin-manganese-nickel-iron, gold-nickel, gold-palladium-nickel, gold-copper-nickel, silver-copper-zinc-nickel, silver-manganese, silver-copper-zinc-cadmium, silver-copper-tin, cobalt-silicon-chromium-nickel-tungsten, cobalt-silicon-chromium-nickel-tungsten-boron, manganese-nickel-cobalt-boron, nickel-silicon-chromium, nickel-chromium-silicon-manganese, nickel-chromium-silicon, nickel-silicon-boron, nickel-silicon-chromium-boron-iron, nickel-phosphorus, nickel-manganese, copper-aluminum, copper-aluminum-nickel, copper-aluminum-nickel-iron, copper-aluminum-nickel-zinc-tin-iron, and the like, and any combination thereof. The metal-matrix composite can also include reinforcement particles.

The reinforcement particles can include diamond or ceramic materials such as carbides, nitrides, oxides, borides, and silicides, and combinations thereof, such as carbonitrides. More specifically, the reinforcement particles can include carbides made from elements such as molybdenum, tungsten, chromium, titanium, niobium, vanadium, tantalum, zirconium, hafnium, manganese, iron, nickel, boron, aluminum, and silicon. Reinforcement particles can include borides made from elements such as titanium, zirconium, hafnium, vanadium, niobium, tantalum, chromium, molybdenum, tungsten, iron, cobalt, nickel, and lanthanum. Reinforcement particles can include nitrides made from elements such as boron, silicon, aluminum, iron, nickel, scandium, yttrium, titanium, vanadium, chromium, zirconium, molybdenum, tungsten, tantalum, hafnium, manganese, and niobium. Reinforcement particles can include oxides made from elements such as silicon, aluminum, yttrium, zirconium, and titanium. By way of example and not limitation, materials that can be used to form reinforcement particles include tungsten carbide (WC, $W_2C$), titanium carbide (TiC), tantalum carbide (TaC), titanium diboride ($TiB_2$), chromium carbides, titanium nitride (TiN), vanadium carbide (VC), aluminum oxide ($Al_2O_3$), aluminum nitride (AlN), boron nitride (BN), boron carbide ($B_4C$), and silicon carbide (SiC). In at least one example, when using Cu alloy materials as the matrix, it is particularly desirable to use tungsten carbide particles in the various morphologies described herein to form the metal-matrix composite. Furthermore, combinations of different reinforcement particles can be used to tailor the physical properties and characteristics of the metal-matrix composite. The reinforcement particles can be formed using techniques known to those of ordinary skill in the art. Most suitable materials for reinforcement particles are commercially available and the formation of the remainder is within the ability of one of ordinary skill in the art.

The ductile inserts 126 are strategically positioned at locations of the drill bit 100 that experience high stress. The ductile inserts 126 comprise any of a variety of ductile materials selected for the intended application. The selected ductile material of the ductile inserts 126 is more ductile than the composite material making up the body 108 of the drill bit 100, for example the metal-matrix composite body 108. Ductility is generally understood as the ability of a material to plastically deform before failure, and can be determined during a standard materials test, such as a tensile test. In particular, ductile materials undergo elastic deformation as well as a degree of plastic deformation before rupturing. On the other hand, brittle materials undergo comparatively little and possibly negligible plastic deformation before rupturing. One measure of ductility is elongation, or strain ($\varepsilon$), which can be expressed as change in length ($\Delta L$) per unit length (L), or $\varepsilon=\Delta L/L$. Another measure of ductility is toughness, which is defined as the area under the stress-strain curve and is a measure of the absorbed plastic strain energy. Elongation and toughness can be determined by standard tensile tests, such as ASTM E8 (for metallic materials), where the selection of the particular test may depend on the particular material being tested.

The ductile inserts 126 disclosed herein can be made up of a ductile material with an elongation of at least 3% before rupture, alternatively at least 6% before rupture, alternatively at least 10% before rupture. For example, the ductile material herein may have an elongation from 2 to 100% before rupture. In contrast, a non-ductile, or brittle, material may have an elongation of less than 2% before rupture. In some examples, the ductile material can have a ductility that is greater than 4 times the ductility of the metal-matrix composite of the body 108. For example, the metal-matrix composite can have a ductility of less than 1% before rupture while the ductile material can have a ductility of at least 4% before rupture.

The ductile material can include any metal or alloy that exhibits sufficient ductility compared to that of the metal-matrix composite material and is refractory to (does not melt during) the infiltration process. Depending on the processing temperature during manufacture, examples of suitable materials include, but are not limited to, tungsten, rhenium, osmium, tantalum, molybdenum, niobium, iridium, ruthenium, hafnium, boron, rhodium, vanadium, chromium, zirconium, platinum, titanium, lutetium, palladium, thulium, scandium, iron, yttrium, erbium, cobalt, holmium, nickel, silicon, dysprosium, terbium, gadolinium, beryllium, manganese, copper, samarium, gold, neodymium, silver, germanium, praseodymium, lanthanum, and any alloy or combination thereof. Examples of alloys include, but are not limited to, tantalum-tungsten, tantalum-tungsten-molybdenum, tantalum-tungsten-rhenium, tantalum-tungsten-molybdenum-rhenium, tantalum-tungsten-zirconium, tungsten-rhenium, tungsten-molybdenum, tungsten-rhenium-molybdenum, tungsten-molybdenum-hafnium, tungsten-molybdenum-zirconium, tungsten-ruthenium, niobium-vanadium, niobium-vanadium-titanium, niobium-zirconium, niobium-tungsten-zirconium, niobium-hafnium-titanium, niobium-tungsten-hafnium, nickel-copper, nickel-chromium, nickel-chromium-iron, nickel-chromium-molybdenum, nickel-molybdenum, HASTELLOY® alloys (i.e., nickel-chromium containing alloys, available from Haynes International), INCONEL® alloys (i.e., austenitic nickel-chromium containing superalloys available from Special Metals Corporation), WASPALOYS® (i.e., austenitic nickel-based superalloys), RENE® alloys (i.e., nickel-chromium containing alloys available from Altemp Alloys, Inc.), HAYNES® alloys (i.e., nickel-chromium containing superalloys available from Haynes International), MP98T (i.e., a nickel-copper-chromium superalloy available from SPS Technologies), TMS alloys, CMSX® alloys (i.e., nickel-based superalloys available from C-M Group), cobalt alloy 6B (i.e., cobalt-based superalloy available from HPA), and N-155 alloys.

The ductile inserts 126 can be disposed within the body 108. The ductile inserts 126 can be exposed from the body 108 at one or more high-stress portions of the drill bit 100. The ductile inserts 126 can be substantially flush with the external surface of the body 108. When the ductile inserts 126 are substantially flush with the external surface, the external surface of the ductile inserts 126 is substantially aligned with the external surface of the body 108. The high-stress portions of the drill bit 100 can be any portion where the drill bit 100 can crack or fail. The high-stress portions of the drill bit 100 can be determined by at least one of modeling, such as stress modeling, thermal modeling, thermo-mechanical modeling, mechanical experience, operational experience, manufacturing experience, test bits or coupons, or any suitable method to determine portions experiencing high stress. For example, regarding operational experience, if a portion of the drill bit 100 is regularly cracking, then ductile inserts 126 can be disposed in the body 108 and exposed at the portion that is regularly cracking.

FIGS. 2-6 illustrate example embodiments of drill bits with ductile inserts exposed at various high-stress portions. The configurations of the drill bit and the ductile inserts are not limited to the example embodiments herein. Ductile inserts 126 can be exposed at the root 112 of the blade 102 as shown in FIG. 2. The root 112 of the blade 102 can be defined as the portion where the blades 102 extend from the central portion 104 of the body 108 and/or where the blade 102 meets the junk slot 124. The ductile inserts 126 can be exposed at the root 112 of at least one blade 102 of the drill bit 100. For example, the ductile inserts 126 can be exposed at the root 112 of multiple or every blade 102 of the drill bit 100. The ductile inserts 126 can be exposed at a portion of the blade 102, the junk slot 124, and/or the root 112. The ductile inserts 126 can be exposed only at these portions (e.g. only at the root 112), or the ductile inserts 126 can be exposed at an area greater than these portions (e.g. an area greater than the root 112).

It will be understood that exposure of the ductile inserts 126 at a particular portion or area as discussed herein includes also the substantially immediate or proximate area around or near the discussed portion or area. Additionally, the surfaces of the ductile inserts 126 that are not exposed may have surface features formed thereon to promote bonding and adhesion between the metal-matrix composite and ductile materials. Examples of such features include dimples, divots, threads, recesses, grooves, channels, protrusions, perforations, nubs, fins, knurling, castellations, any combination thereof, and the like.

Figure 3:
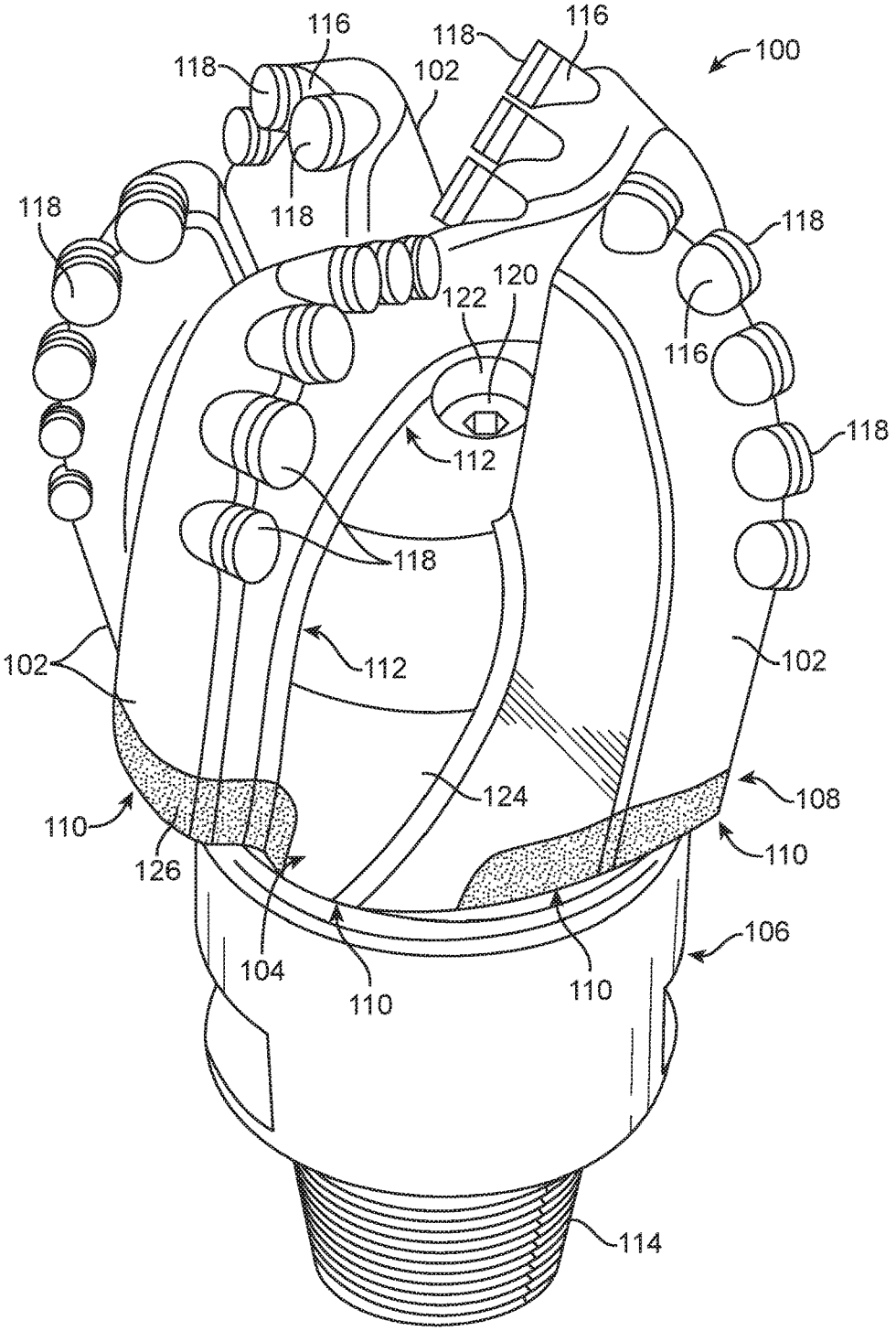
FIG. 3 is a diagram illustrating a second embodiment of a drill bit according to the disclosure herein.

Ductile inserts 126 can also be exposed at the bevel 110 as shown in FIG. 3. As the bevel 110 protrudes from the central portion 104 of the body 108, when the drill string 18 (shown in FIG. 1) is retracted, the bevel 110 of the drill bit 100 can be impacted, causing damage such as cracks or possible failure of the drill bit 100. Therefore, the ductile inserts 126 can be exposed at the bevel 110 to prevent or mitigate damage to the drill bit 100.

Figure 4:
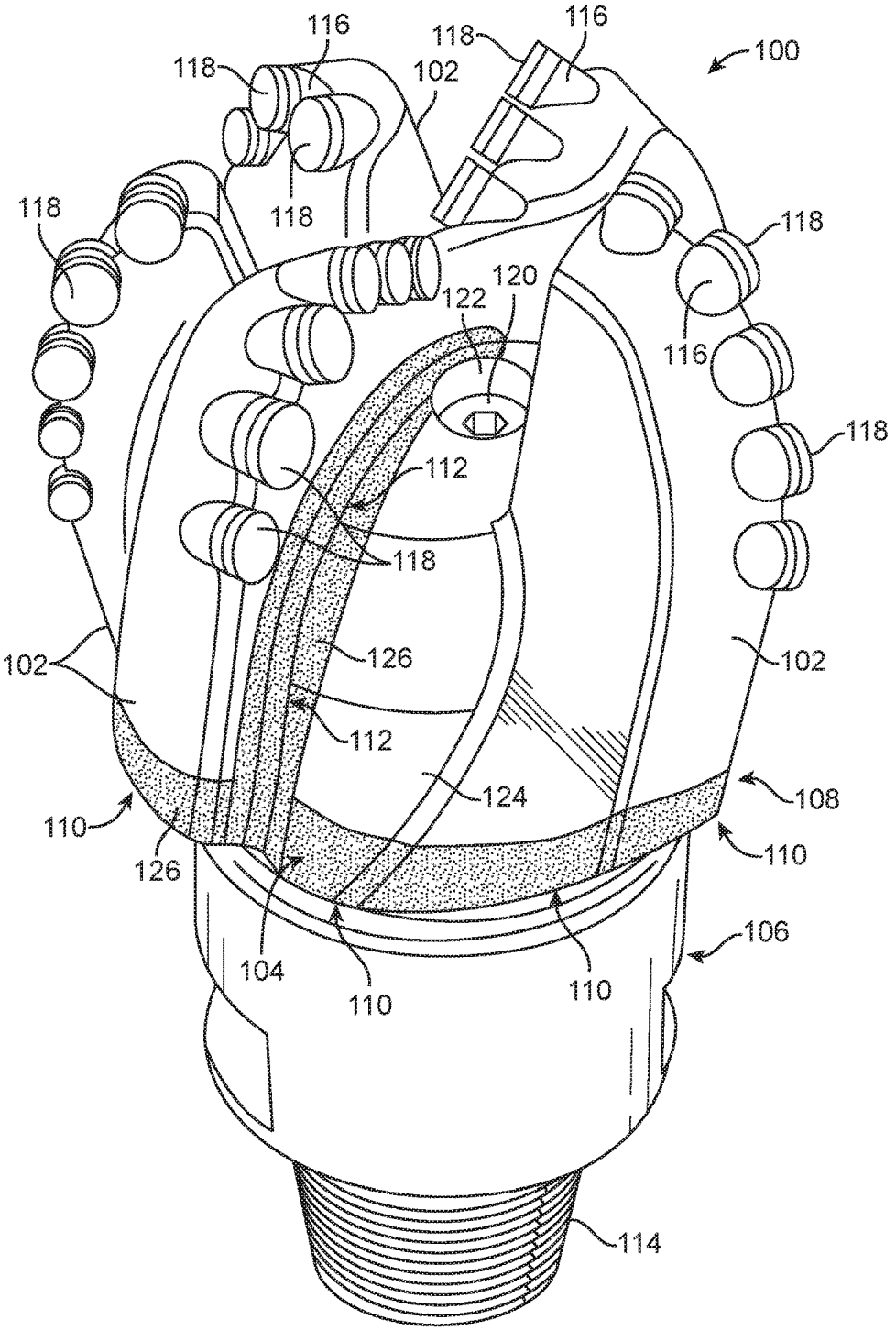
FIG. 4 is a diagram illustrating a third embodiment of a drill bit according to the disclosure herein.

In other examples, ductile inserts 126 can be exposed at multiple portions that experience high stress, as shown in FIG. 4. In the illustrated embodiment, ductile inserts 126 are exposed at both the bevel 110 and the root 112; in this embodiment, the root reinforcement is wider than that shown in FIG. 2. Other high-stress portions can include the nozzle 122, the nozzle threads (not shown), or the proximal portion of the body 108 where the blades 102 converge (not shown).

Figure 5:
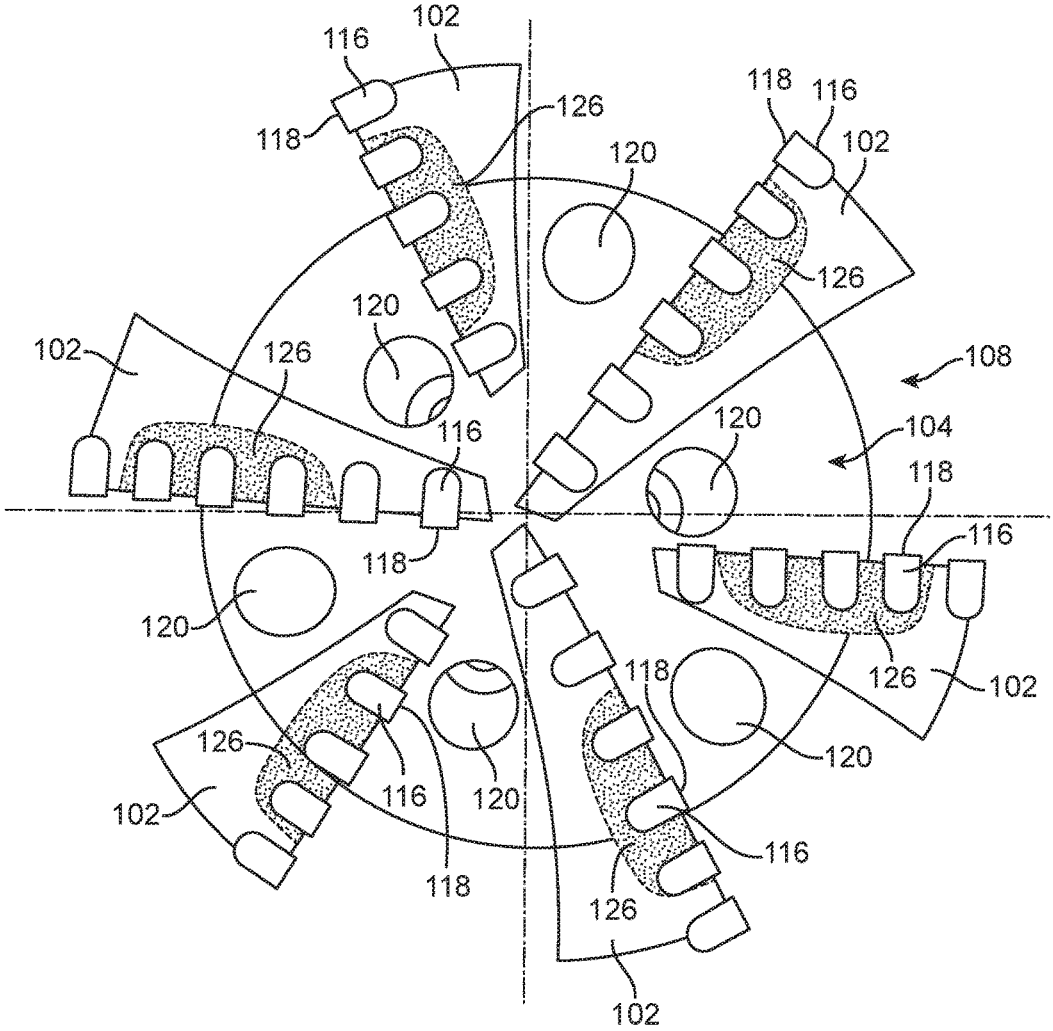
FIG. 5 is a diagram illustrating a top view of a fourth embodiment of a drill bit according to the disclosure herein.

Another high-stress portion can include the portion of the blades 102 that includes the cutters 118, as shown in FIG. 5. The cutters 118 and the cutter pockets 116 can experience high stress while maneuvering through and removing the downhole formation material. As such, ductile inserts 126 can be exposed at the portion of the blade 102 surrounding the cutters 118 and the cutter pockets 116. In the embodiment shown in FIG. 5, the ductile insert 126 is localized to those cutter pockets 116 that protrude most from the apex region of the drill bit 100.

Figure 6:
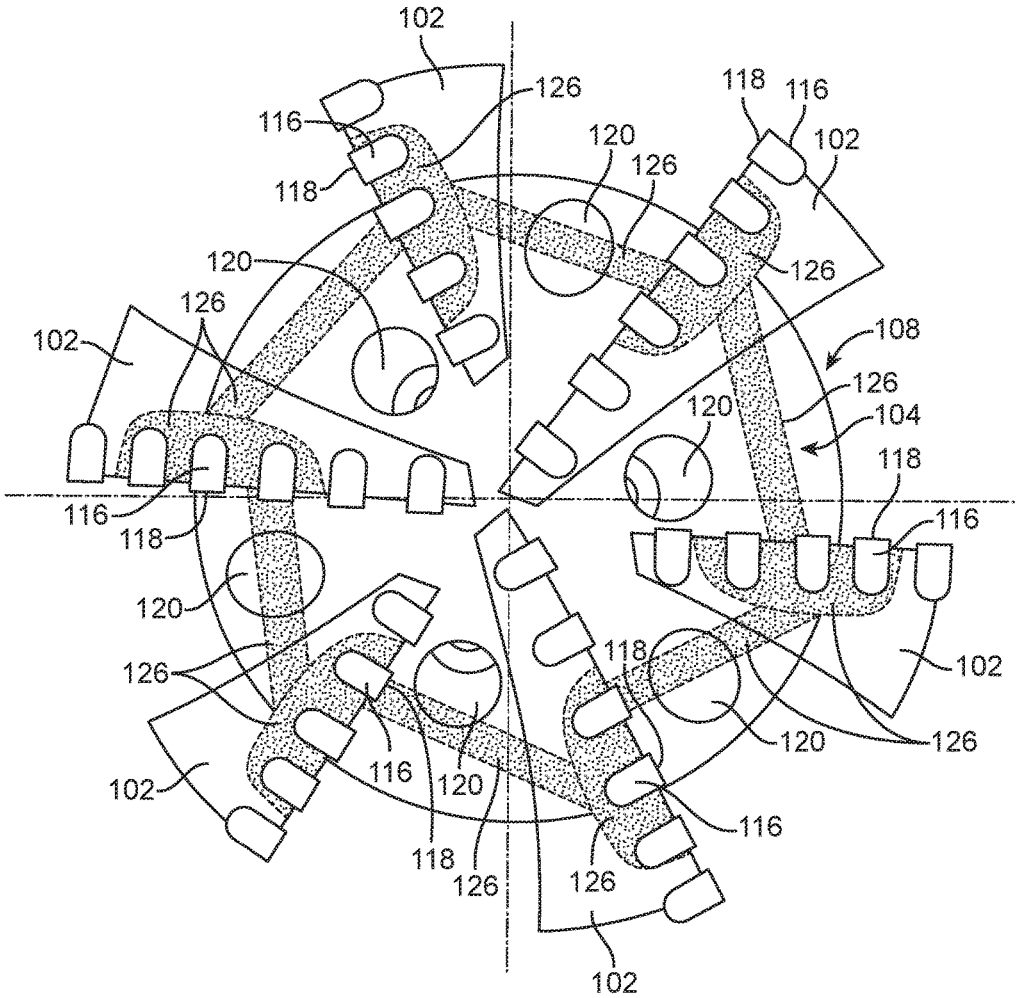
FIG. 6 is a diagram illustrating a top view of a fifth embodiment of a drill bit according to the disclosure herein.

To accommodate high-force loads, the ductile inserts 126 can be interlinked, as shown in FIG. 6, such that the load on one portion will be partially transferred amongst the linked portions, thereby sharing loads. Doing so can mitigate stresses in situations where, for example, the drill bit 100 is experiencing high-force loads on a single blade 102 and the interlinked ductile inserts 126 can reduce the chance of blade failure. In the illustrated embodiment, the ductile inserts 126 are exposed at the blades 102 around the cutters 118 and the cutter pockets 116. The ductile inserts 126 are internally interlinked, which allows the loads to be transferred substantially uniformly across all of the blades 102.

The ductile inserts 126 can be any shape or size to reduce or eliminate cracking and failure to the drill bit 100 while maintaining the function of the drill bit 100. The ductile inserts 126 can be thin and provided as substantially surface modifications. Alternatively, the ductile inserts 126 can be disposed deeper within the body 108 of the drill bit 100, similar to the body of an iceberg under water. The ductile inserts 126 can be exposed to the extent necessary to reduce or eliminate cracking and failure to the drill bit 100 while maintaining the function of the drill bit 100. The ductile inserts 126 can eliminate or reduce stress by being shaped to replace portions of the metal-matrix composite bit body 108 that experience high stresses. Locations of stress concentration can be identified by stress/strain modeling, mechanical design handbooks, or design/manufacturing experience. Examples of stress-concentrating features or geometries include sharp corners, such as the threads in nozzle channels, nozzle channel-to-landing transition, or blade bevels.

With knowledge of the stress and/or strain experienced in certain regions of the metal-matrix composite bit body 108, the ductile inserts 126 can be shaped, sized, and positioned at the portions that experience high stresses. As such, the drill bit 100 has increased ductility and crack resistance at typical high-stress portions without sacrificing the amount of erosion-resistant particles at and near the surfaces of the drill bit 100.

Figure 7:
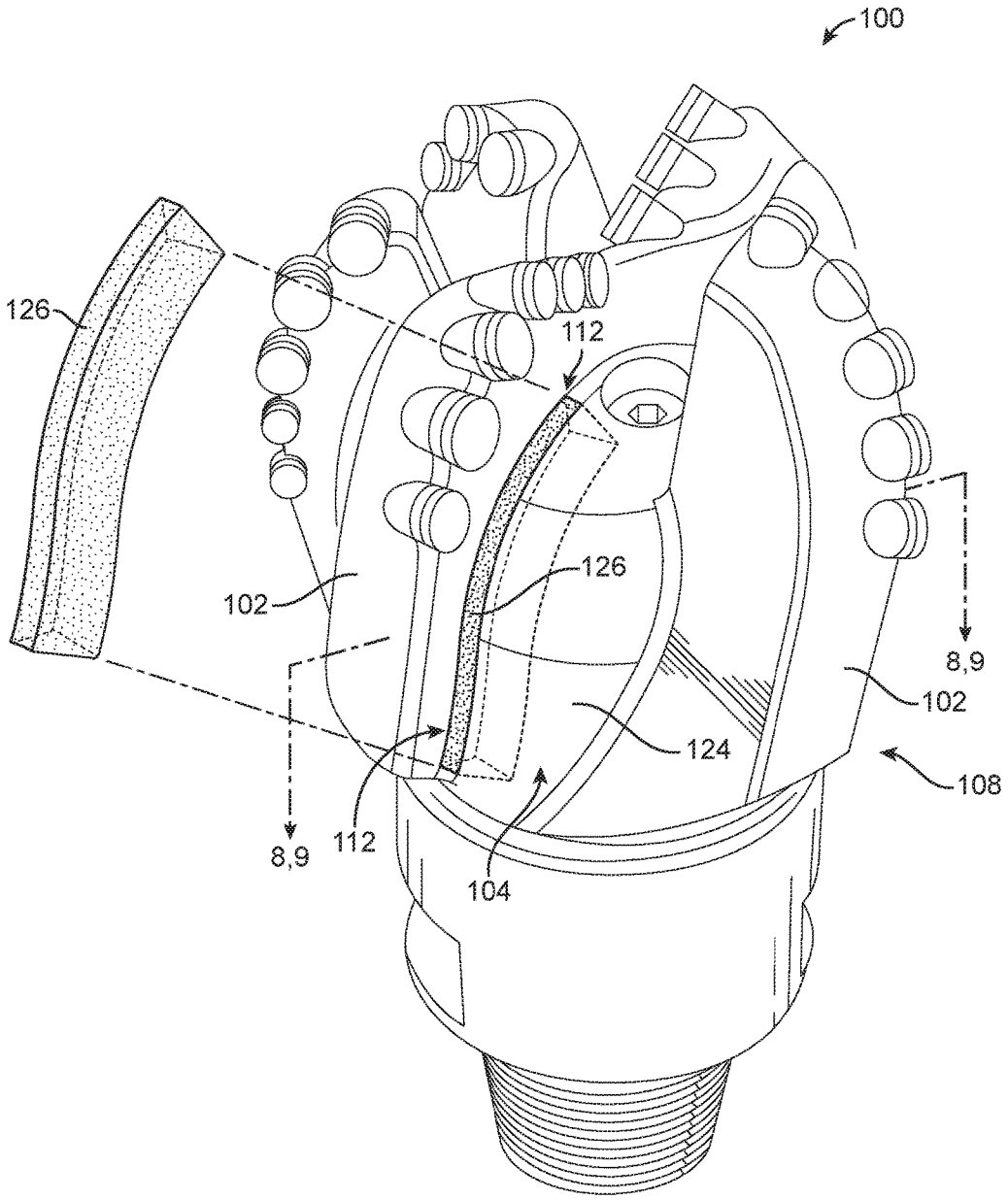
FIG. 7 is a diagram illustrating the first embodiment of the drill bit according to the disclosure herein.
Figure 8:
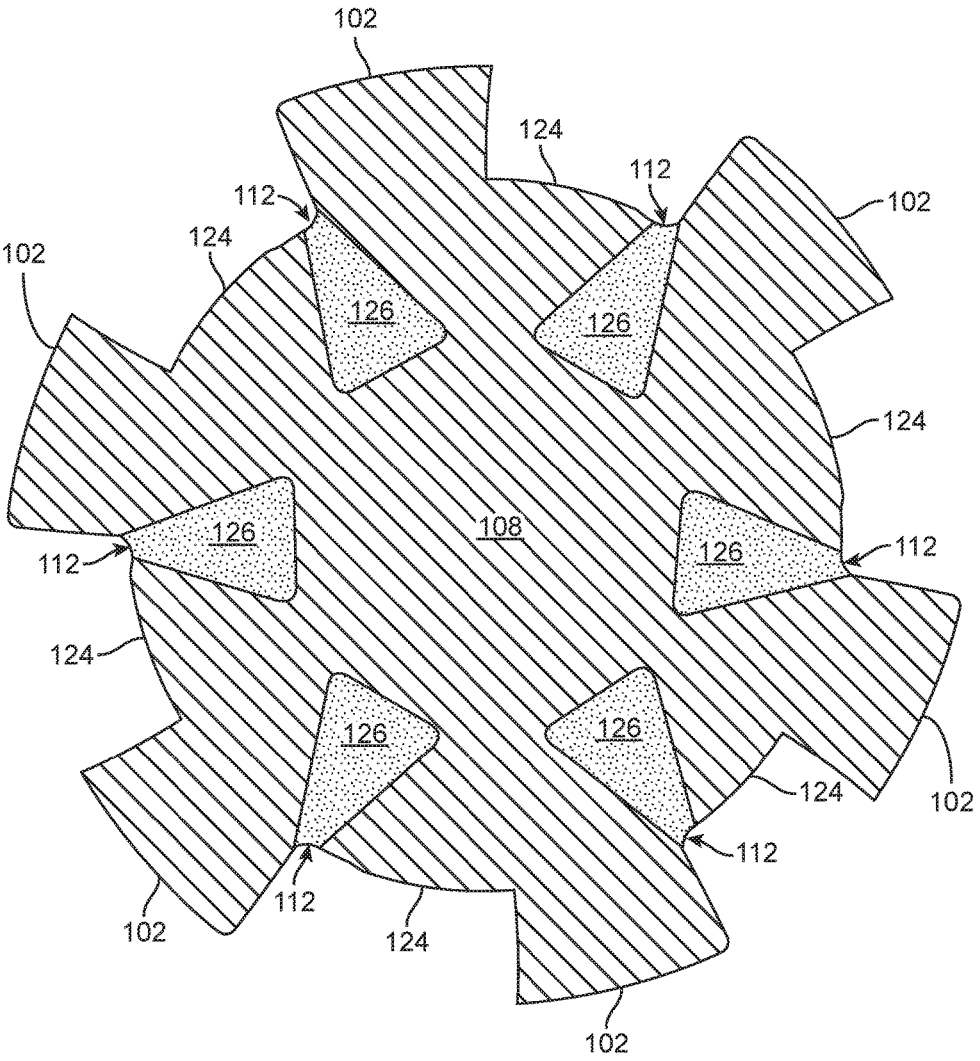
FIG. 8 is a cross-sectional view taken along the line 8,9-8,9 of FIG. 8 according to the disclosure herein.
Figure 9:
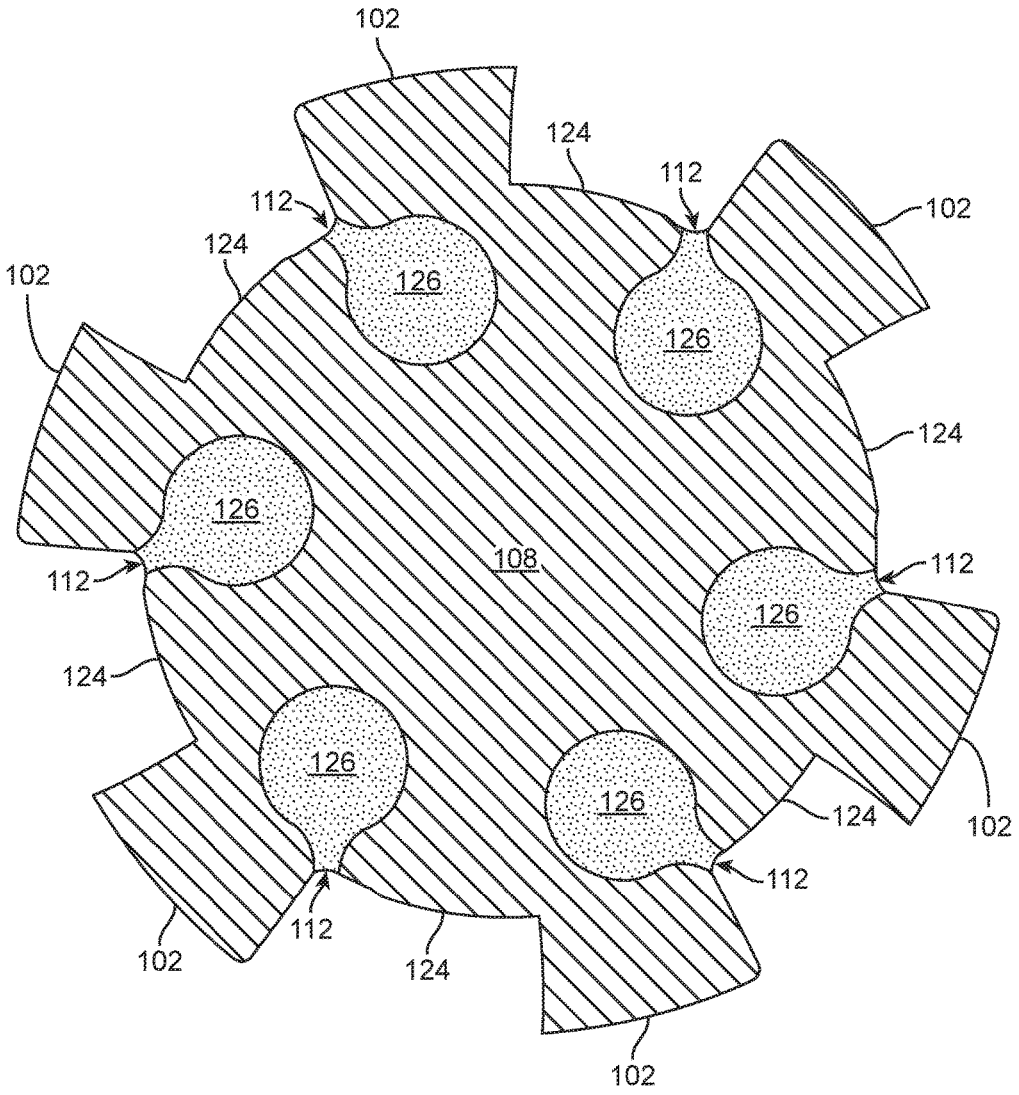
FIG. 9 is a cross-sectional view taken along the line 8,9-8,9 of FIG. 8 according to the disclosure herein.

Examples of the size, shape, and depth of ductile inserts 126 are shown in FIGS. 7-9. FIG. 7 illustrates the drill bit 100 of FIG. 2. However, FIG. 7 shows ductile inserts 126 that are disposed within the body 108 of the drill bit 100 while being exposed at the high-stress portions, for example the root 112. The ductile inserts 126 are also substantially flush with the external surface of the body 108 where exposed. As shown in FIG. 7, the ductile insert can be made of a material different than the material of the body 108 of the drill bit 100.

The ductile inserts 126 can be shaped and sized in a variety of manners, such as to be substantially similar to the shape and size of the portions that experience stress; to displace a suitable amount of composite material, which may reduce costs; or to provide interlocking or increased surface area between the composite and insert materials. In the illustrated embodiment of FIG. 8, the ductile inserts 126 are substantially a triangular shape. In the illustrated embodiment of FIG. 9, the ductile inserts 126 are substantially a bulb shape. However, the ductile inserts 126 can be any shape of size that is suitable for reducing or eliminating cracking and failure of the drill bit 100. The ductile inserts 126 can be exposed substantially at the root 112 of the blade 102. Where exposed, the ductile inserts 126 can be substantially flush with the external surface of the body 108 of the drill bit 100. As such, the exposed end of the ductile inserts 126 are substantially aligned with the external surface of the body 108 of the drill bit 100. Minimization of the exposed external surface of the ductile insert 126 can maintain a suitably high stiff and erosion-resistant outer surface while providing crack resistance during manufacture or operation.

Figure 10:
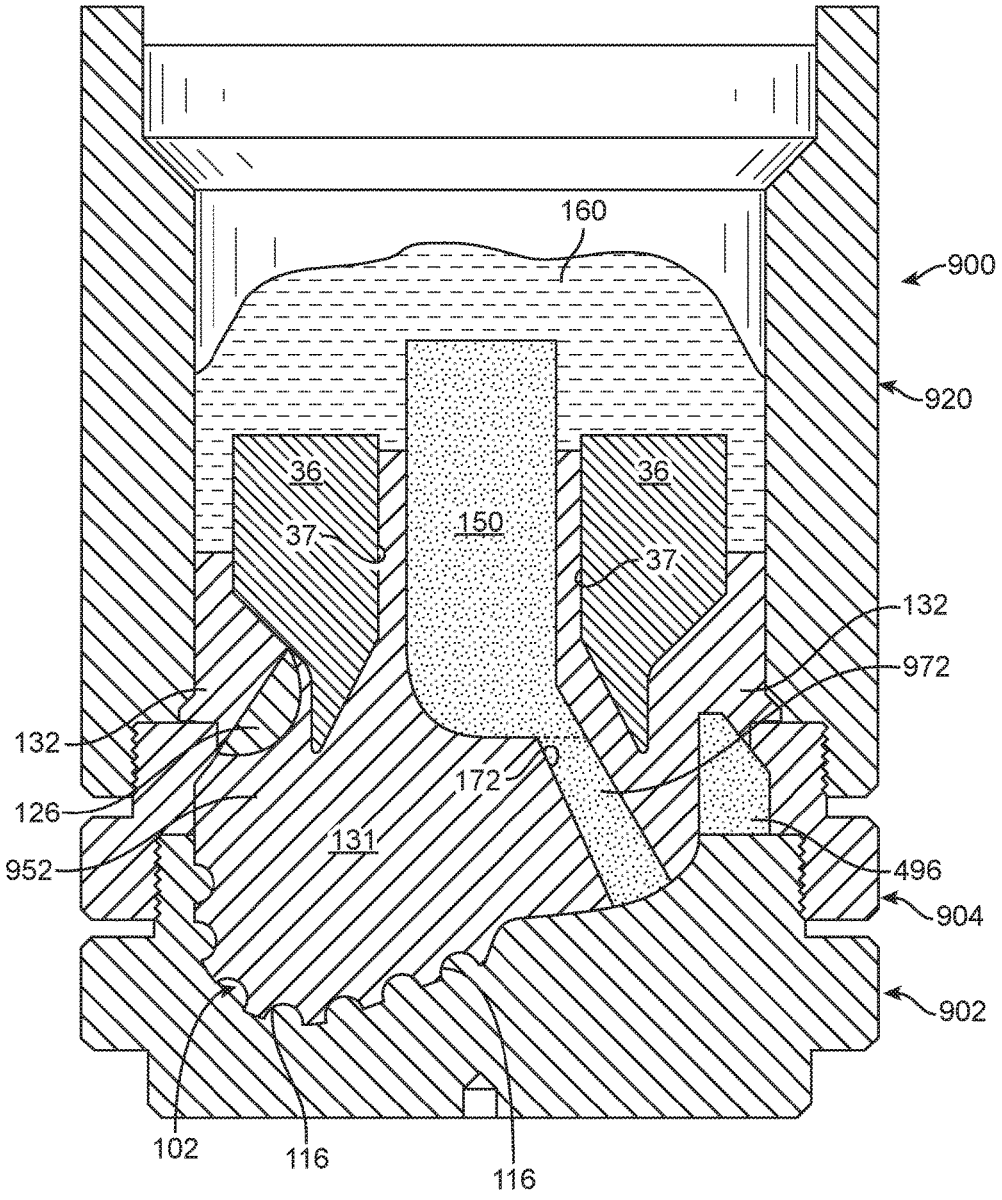
FIG. 10 is a cross-sectional view illustrating a mold with inserts and a metal-matrix composite according to the disclosure herein.

When manufacturing a drill bit, a mold assembly can be used. FIG. 10 is a cross-sectional view illustrating a mold assembly with inserts 126 and a metal-matrix composite forming a body 108 of a drill bit 100. Mold assembly 900 as shown in FIG. 10 can include several components such as a mold 902, a gauge ring or connector ring 904, and a funnel 920. Mold 902, gauge ring 904, and funnel 920 can be formed from graphite or other suitable materials. Various techniques may be used including, but not limited to, machining a graphite blank to form mold cavity 952 having a negative profile or a reverse profile of desired exterior features for a resulting fixed-cutter drill bit. For example mold cavity 954 may have a negative profile which corresponds with the exterior profile or configuration of blades 102 and junk slots 124 as shown in FIG. 2.

Various types of temporary displacement materials and mold inserts can be installed within mold cavity 952 depending on the desired configuration of a resulting matrix drill bit 100. For example mold inserts can be formed from various materials such as consolidated sand and/or graphite and may be disposed within mold cavity. Various resins can be satisfactorily used to form consolidated sand. Mold inserts can have configurations and dimensions corresponding with desired features of body 108 such as cutter pockets 116 formed in blades 102. The dimensions and configuration of mold inserts and associated cutter pockets 116 may be selected to correspond with desired dimensions and configuration for cutters 118 in respective blades 102.

Displacement materials such as consolidated sand can be installed within mold assembly 900 at desired locations to form portions of cavity 952 and fluid flow passages 972 extending therefrom. The orientation and configuration of consolidated sand legs 172 can be selected to correspond with desired locations and configurations of associated fluid flow passageways 972 communicating from cavity 952 to respective nozzles 122. Further, in the illustrated embodiment, a junk slot displacement 496 can correspond with the junk slots 124 as shown in FIG. 2.

A relatively large, generally cylindrically shaped consolidated sand core 150 can be placed on the legs 172. The number of legs extending from sand core 150 will depend upon the desired number of nozzle openings in a resulting body.

Ductile inserts 126 can be installed within mold assembly 900 at desired locations while being exposed and flush with the external surface of the body 108 of the drill bit 100. The ductile insert 126 shown in FIG. 10 illustrates an insert placed in a blade bevel region. Alternatively, the ductile insert 126 may be placed at other locations in the mold assembly 900, such as at or near the blade root, nozzle channel, nozzle threads, cutter pockets, and blade standoffs. The ductile inserts 126 can be pre-formed. The ductile inserts 126 can be installed within the mold assembly 900 by any suitable methods. For example, a person can manually hold the ductile inserts 126 at the desired locations. As another example, various fixtures (not shown) can be used to position the ductile inserts 126 within the mold assembly 900 at the desired locations. The ductile inserts 126 can be positioned before, during, or after placement of the reinforcement material 131 described below. Alternatively, the ductile inserts 126 can be formed to extend past the final surface of the body 108 such that the ductile inserts 126 can be machined to be flush with the final surface of the body 108 in a subsequent operation.

After desired displacement materials, including core 150 and legs 172, have been installed within mold assembly 900, reinforcement material 131 having desired characteristics for the body 108 can be placed within mold assembly 900. The exemplary reinforcement material 131 can be tungsten carbide. The present disclosure allows the use of reinforcement materials having characteristics of toughness and wear resistance for forming a fixed-cutter drill bit.

A generally hollow, cylindrical bit blank 36 can be placed within mold assembly 900. Bit blank 36 can include an inside diameter 37 which is larger than the outside diameter of the core 150. Various fixtures (not shown) can be used to position bit blank 36 within mold assembly 900 at a desired location spaced from reinforcement material 131.

The shoulder material 132, such as tungsten powder, can be placed in mold assembly 900 between exterior portions of bit blank 36 and adjacent interior portions of funnel 920. Shoulder material 132 can be a relatively soft powder which forms a matrix that may subsequently be machined to provide a desired exterior configuration and transition between body 108 and bit blank 36.

Reinforcement material 131 can be reinforcement particles such as cemented carbides and/or spherical carbides. Alloys of cobalt, iron, and/or nickel can be used as an infiltration aid.

A typical infiltration process for forming the body 108 can begin by forming mold assembly 900. Gage ring 904 can be threaded onto the top of mold 902. Displacement materials such as, but not limited to, ductile inserts 126, legs 172, and sand core 150 can then be loaded into mold assembly 900 if not previously placed in mold cavity 952. Reinforcement material 131, shoulder material 132, and bit blank 36 can be loaded into mold assembly 900. Funnel 920 can be threaded onto the top of gage ring 904 to extend mold assembly 900 to a desired height to hold reinforcement material 131, shoulder material 132, and binding material 160.

As mold assembly 900 is being filled with reinforcement material 131 and shoulder material 132, a series of vibration cycles can be induced in mold assembly 900 to assist desired distribution of each layer or zone of reinforcement material 131 and shoulder material 132. Vibrations help to ensure consistent and compacted density of each layer of reinforcement material 131 and shoulder material 132 within respective ranges required to achieve desired characteristics for the body 108. As such, the vibrations can help compact the reinforcement material 131 and shoulder material 132 within the mold assembly 900.

Binding material 160 can be placed on top of layer 132, bit blank 36 and core 150. Binding material 160 may be covered with a flux layer (not expressly shown). A cover or lid (not shown) can be placed over mold assembly 900. Mold assembly 900 and materials disposed therein can be preheated and then placed in a furnace (not shown). When the furnace temperature reaches the melting point of binding material 160, liquid binding material 160 can infiltrate reinforcement material 131 and shoulder material 132. The ductile material of the ductile inserts 126 can have a melting point greater than the melting point of the binding material 160. As such, the ductile inserts 126 do not melt in the process.

Mold assembly 900 can then be removed from the furnace and cooled at a controlled rate. The body 108 of the drill bit 100 then includes a metal-matrix composite with at least one ductile insert 126 partially disposed within the metal-matrix composite. Once cooled, mold assembly 900 can be broken away to expose the body 108.

Figure 11:
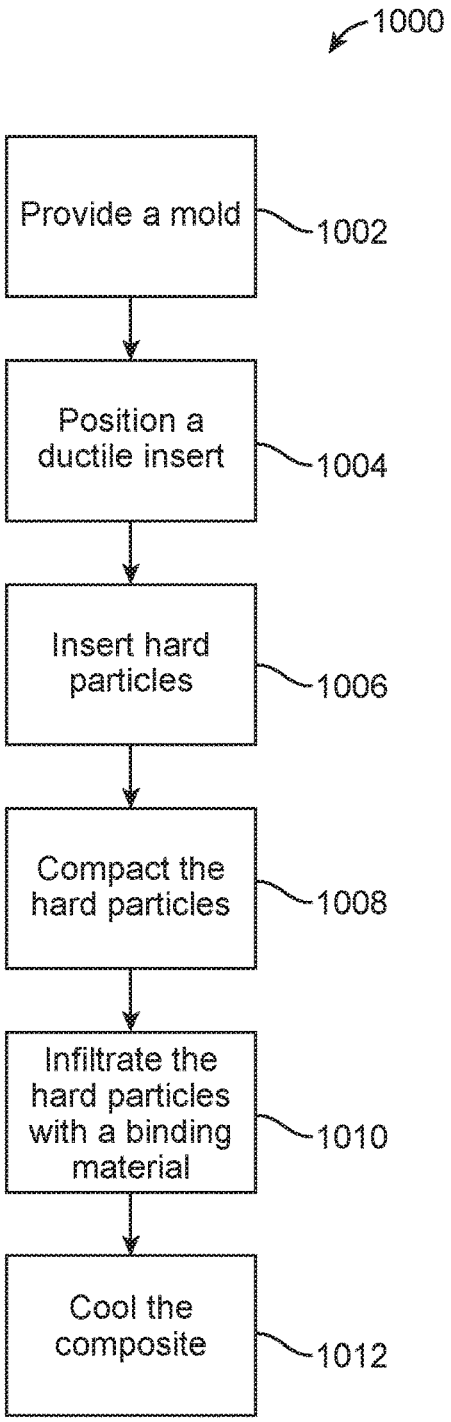
FIG. 11 is a flow chart of a method of manufacturing a drill bit according to the disclosure herein.

Referring to FIG. 11, a flowchart is presented in accordance with an example embodiment. The method 1000 is provided by way of example, as there are a variety of ways to carry out the method. The method 1000 described below can be carried out using the configurations illustrated in FIGS. 1-10, for example, and various elements of these figures are referenced in explaining example method 1000. Each block shown in FIG. 11 represents one or more processes, methods, or subroutines, carried out in the example method 1000. Furthermore, the illustrated order of blocks is illustrative only and the order of the blocks can change according to the present disclosure. Additional blocks may be added or fewer blocks may be utilized, without departing from this disclosure. The example method 1000 can begin at block 1002.

At block 1002, a mold can be provided. The mold can be coupled to a gage ring. The gage ring can be coupled to a funnel. The mold can define a body of the drill bit.

At block 1004, at least one ductile insert can be positioned within the mold. The ductile inserts can be made of a material that has a ductility greater than a ductility of the material of the body. For example, the ductile inserts can be made of iron. The ductile inserts can be pre-formed, where the ductile inserts are formed before being positioned within the mold. The ductile inserts can be positioned such that the ductile inserts are disposed within the body of the drill bit, but also exposed and flush with the external surface of the body. The ductile inserts can further be positioned such that the ductile inserts are exposed at high-stress portions of the drill bit, which can be determined by at least one of modeling, such as stress modeling, thermal modeling, thermo-mechanical modeling, mechanical experience, operational experience, manufacturing experience, test bits or coupons, or any suitable method to determine portions experiencing high stress. The ductile inserts can be interlinked with ductile material. Various fixtures can be used to position the ductile inserts within the mold at the desired locations.

At block 1006, reinforcement particles can be inserted into the mold. The reinforcement particles can be any suitable material as described above. For example, the reinforcement particles can be tungsten carbide. The reinforcement particles can be inserted around the ductile inserts.

At block 1008, the reinforcement particles can be compacted. The reinforcement particles can be compacted by vibration, which also can assist in achieving a desired distribution of the reinforcement particles. The compacting of the reinforcement particles also helps secure the positioning of the ductile inserts.

At block 1010, the reinforcement particles can be infiltrated with a binding material. The binding material can be heated such that the binding material melts and flows into the compacted mass of reinforcement particles. The binding material can be any suitable material as described above, for example a copper-nickel alloy. The binding material can have a melting point lower than the melting points of the ductile inserts and the reinforcement particles. The infiltration of the reinforcement particles with the binding material can form a metal-matrix composite. The binding material also surrounds the ductile inserts.

At block 1012, the metal-matrix composite can be cooled to solidify the metal-matrix composite and form the body of the drill bit. As such, the body can include the ductile inserts disposed within the body while being exposed and flush with the external surface at high-stress portions. Once cooled, the mold can be broken away to expose the body.

Numerous examples are provided herein to enhance understanding of the present disclosure. A specific set of examples are provided as follows.

In a first example, there is disclosed a fixed-cutter drill bit including: a metal-matrix composite body having at least one metal-matrix composite blade formed in the body; a plurality of cutters disposed on the at least one metal-matrix composite blade; and a ductile insert partially disposed within the metal-matrix composite body and having an exposed surface, wherein the ductile insert has a greater ductility than the metal-matrix composite body.

In a second example, a fixed-cutter drill bit is disclosed according to the preceding example, wherein the exposed surface of the ductile insert is flush with an external surface of the metal-matrix composite body.

In a third example, a fixed-cutter drill bit is disclosed according to any of the preceding examples, wherein the exposed surface of the ductile insert is positioned at or proximate to at least one high-stress portion of the fixed-cutter drill bit.

In a fourth example, a fixed-cutter drill bit is disclosed according to any of the preceding examples, wherein the exposed surface is located at or proximate to a root portion of the at least one metal-matrix composite blade, the root portion being the portion where the at least one metal-matrix composite blade extends from a central portion of the metal-matrix composite body.

In a fifth example, a fixed-cutter drill bit is disclosed according to any of the preceding examples, wherein the metal-matrix composite body comprises a proximal portion having the at least one metal-matrix composite blade, and a distal portion having a bevel, the exposed surface of the ductile insert being located at or proximate to the bevel.

In a sixth example, a fixed-cutter drill bit is disclosed according to any of the preceding examples, wherein the metal-matrix composite body includes at least one of a plurality of cutter pockets corresponding to the plurality of cutters, a nozzle channel, a nozzle thread, or a blade standoff, wherein a ductile insert provided at or proximate to at least one of the plurality of cutter pockets corresponding to the plurality of cutters, the nozzle channel, the nozzle thread, or the blade standoff.

In a seventh example, a fixed-cutter drill bit is disclosed according to any of the preceding examples, wherein the ductile insert comprises a metal or a metal alloy.

In an eighth example, a fixed-cutter drill bit is disclosed according to any of the preceding examples, wherein the ductile insert exhibits an elongation of at least 3% without rupture.

In a ninth example, a fixed-cutter drill bit is disclosed according to any of the preceding examples, wherein the ductile insert can realize an elongation of at least 10% without rupture.

In a tenth example, a fixed-cutter drill bit is disclosed according to any of the preceding examples, wherein the metal-matrix composite material making up the metal-matrix composite body and metal-matrix composite blade exhibits an elongation of less than 2% before rupture.

In an eleventh example, a fixed-cutter drill bit is disclosed according to any of the preceding examples, wherein the metal-matrix composite body includes tungsten carbide.

In a twelfth example, a system is disclosed including a drill string provided in a wellbore, the drill string having a downhole drilling device with a drill bit disposed on its lower end; and the drill bit including: a metal-matrix composite body having at least one metal-matrix composite blade; a plurality of cutters disposed on the at least one metal-matrix composite blade; and a ductile insert partially disposed within the metal-matrix composite body and having an exposed surface, wherein the ductile insert has a greater ductility than the metal-matrix composite body.

In a thirteenth example, a system is disclosed according to the twelfth example, wherein the exposed surface of the ductile insert is flush with an external surface of the metal-matrix composite body.

In a fourteenth example, a system is disclosed according to the twelfth or thirteenth examples, wherein the exposed surface of the ductile insert is positioned at or proximate to at least one high-stress portion of the fixed-cutter drill bit.

In a fifteenth example, a system is disclosed according to any of the preceding twelfth to the fourteenth examples, wherein the exposed surface is located at or proximate to a root portion of the at least one blade, the root portion being the portion where the at least one blade extends from a central portion of the metal-matrix composite body.

In a sixteenth example, a system is disclosed according to any of the preceding twelfth to the fifteenth examples, wherein the metal-matrix composite body has a proximal portion having the at least one metal-matrix composite blade, and a distal portion having a bevel, the exposed surface of the ductile insert being located at or proximate the bevel.

In a seventeenth example, a system is disclosed according to any of the preceding twelfth to the sixteenth examples, wherein the ductile insert includes a metal or a metal alloy.

In an eighteenth example, a system is disclosed according to any of the preceding twelfth to the seventeenth examples, wherein the ductile insert exhibits an elongation of at least 3% without rupture.

In a nineteenth example, a system is disclosed according to any of the preceding twelfth to the eighteenth examples, wherein the metal-matrix composite material making up the metal-matrix composite body and metal-matrix composite blade exhibits an elongation of less than 2% before rupture.

In a twentieth example, a system is disclosed according to any of the preceding twelfth to the nineteenth examples, wherein the metal-matrix composite body includes tungsten carbide.

The embodiments shown and described above are only examples. Even though numerous characteristics and advantages of the present technology have been set forth in the foregoing description, together with details of the structure and function of the present disclosure, the disclosure is illustrative only, and changes may be made in the detail, especially in matters of shape, size and arrangement of the parts within the principles of the present disclosure to the full extent indicated by the broad general meaning of the terms used in the attached claims. It will therefore be appreciated that the embodiments described above may be modified within the scope of the appended claims.

What is claimed is:

1. A fixed-cutter drill bit comprising:

a metal-matrix composite body having at least one metal-matrix composite blade; a bit blank disposed within the metal-matrix composite body;

a plurality of cutters disposed on the at least one metal-matrix composite blade; and a ductile insert partially disposed within the metal-matrix composite body and having an exposed surface, wherein the ductile insert has a greater ductility than the metal-matrix composite body;

wherein the exposed surface of the ductile insert is positioned at or proximate to at least one high-stress portion of the fixed-cutter drill bit that experiences a high tensile stress during operation.

2. The fixed-cutter drill bit of claim 1, wherein the exposed surface of the ductile insert is flush with an external surface of the metal-matrix composite body.

3. The fixed-cutter drill bit of claim 1, wherein the exposed surface is located at or proximate to a root portion of the at least one metal-matrix composite blade, the root portion being the portion where the at least one metal-matrix composite blade extends from a central portion of the metal-matrix composite body.

4. The fixed-cutter drill bit of claim 1, wherein the metal-matrix composite body comprises a proximal portion having the at least one metal-matrix composite blade, and a distal portion having a bevel, the exposed surface of the ductile insert being located at or proximate to the bevel.

5. The fixed-cutter drill bit of claim 1, wherein the metal-matrix composite body comprises at least one of a plurality of cutter pockets corresponding to the plurality of cutters, a nozzle channel, a nozzle thread, or a blade standoff, wherein the ductile insert provided at or proximate to at least one of the plurality of cutter pockets corresponding to the plurality of cutters, the nozzle channel, the nozzle thread, or the blade standoff.

6. The fixed-cutter drill bit of claim 1, wherein the ductile insert comprises a metal or a metal alloy.

7. The fixed-cutter drill bit of claim 1, wherein the ductile insert exhibits an elongation of at least 3% without rupture.

8. The fixed-cutter drill bit of claim 1, wherein the ductile insert exhibits an elongation of at least 10% without rupture.

9. The fixed-cutter drill bit of claim 1, wherein the metal-matrix composite material making up the metal-matrix composite body and metal-matrix composite blade exhibits an elongation of less than 2% before rupture.

10. The fixed-cutter drill bit of claim 1, wherein the metal-matrix composite body comprises tungsten carbide.

11. A system comprising:

a drill string provided in a wellbore, the drill string having a downhole drilling device with a drill bit disposed on its lower end; and the drill bit comprising:

a metal-matrix composite body having at least one metal-matrix composite blade;

a bit blank disposed within the metal-matrix composite body;

a plurality of cutters disposed on the at least one metal-matrix composite blade; and a ductile insert partially disposed within the metal-matrix composite body and having an exposed surface, wherein the ductile insert has a greater ductility than the metal-matrix composite body;

wherein the exposed surface of the ductile insert is positioned at or proximate to at least one high-stress portion of the fixed-cutter drill bit that experiences a high tensile stress during operation.

12. The system of claim 11, wherein the exposed surface of the ductile insert is flush with an external surface of the metal-matrix composite body.

13. The system of claim 11, wherein the exposed surface is located at or proximate to a root portion of the at least one blade, the root portion being the portion where the at least one blade extends from a central portion of the metal-matrix composite body.

14. The system of claim 11, wherein the metal-matrix composite body has a proximal portion having the at least one metal-matrix composite blade, and a distal portion having a bevel, the exposed surface of the ductile insert being located at or proximate to the bevel.

15. The system of claim 11, wherein the ductile insert comprises a metal or a metal alloy.

16. The system of claim 11, wherein the ductile insert exhibits an elongation of at least 3% without rupture.

17. The system of claim 11, wherein the metal-matrix composite material making up the metal-matrix composite body and metal-matrix composite blade exhibits an elongation of less than 2% before rupture.

18. The system of claim 11, wherein the metal-matrix composite body comprises tungsten carbide.

19. A fixed-cutter drill bit comprising:

a metal-matrix composite body having at least one metal-matrix composite blade;

a plurality of cutters disposed on the at least one metal-matrix composite blade; and a ductile insert partially disposed within the metal-matrix composite body and having an exposed surface, wherein the ductile insert has a greater ductility than the metal-matrix composite body;

wherein the exposed surface of the ductile insert is positioned at or proximate to at least one high-stress portion of the fixed-cutter drill bit that experiences a high tensile stress during operation, the at least one high-stress portion including a leading portion of the metal-matrix composite blade which extends substantially longitudinally along the metal-matrix composite body.

* * * * *